US010225916B2

(12) United States Patent
Loomis et al.

(10) Patent No.: US 10,225,916 B2
(45) Date of Patent: Mar. 5, 2019

(54) DATA/POWER CONTROLLER FOR TRANSLATION BETWEEN LIGHT CONTROL PROTOCOLS

(71) Applicant: Seasons 4, Inc., Toano, VA (US)

(72) Inventors: Jason Loomis, Decatur, GA (US); Jared William Everline, Atlanta, GA (US)

(73) Assignee: Seasons 4, Inc., Toano, VA (US)

( * ) Notice: Subject to any disclaimer, the term of this patent is extended or adjusted under 35 U.S.C. 154(b) by 0 days.

(21) Appl. No.: 15/991,754

(22) Filed: May 29, 2018

(65) Prior Publication Data

US 2018/0295701 A1 Oct. 11, 2018

Related U.S. Application Data

(63) Continuation-in-part of application No. 15/967,184, filed on Apr. 30, 2018, now Pat. No. 10,117,298, which is a continuation-in-part of application No. 15/484,847, filed on Apr. 11, 2017, now Pat. No. 9,986,610.

(51) Int. Cl.

| | |
|---|---|
| ***H05B 33/08*** | (2006.01) |
| ***H05B 37/02*** | (2006.01) |
| ***F21S 4/15*** | (2016.01) |
| ***F21S 4/26*** | (2016.01) |

(52) U.S. Cl.

CPC ..... *H05B 37/029* (2013.01); *F21S 4/15* (2016.01); *F21S 4/26* (2016.01); *H05B 37/0254* (2013.01)

(58) Field of Classification Search

CPC ..... H05B 33/08; H05B 33/0845; H05B 33/0857; H05B 33/0824; F21V 23/02; F21V 23/001; F21V 23/06; F21Y 2103/10; F21Y 2113/13; F21Y 2115/10; F21W 2121/00

USPC .... 315/129–134, 185 R, 150–152, 291, 307, 315/308, 312

See application file for complete search history.

(56) References Cited

U.S. PATENT DOCUMENTS

| | | | | |
|---|---|---|---|---|
| 7,508,141 | B2 * | 3/2009 | Wong | H05B 33/0842 315/185 R |
| 8,217,587 | B2 | 7/2012 | Sauerlaender | |
| 8,450,950 | B2 | 5/2013 | McRae | |
| 8,807,796 | B2 | 8/2014 | Li | |

(Continued)

*Primary Examiner* — Jimmy T Vu

(74) *Attorney, Agent, or Firm* — Kinney & Lange, P.A.

(57) ABSTRACT

Apparatus and associated methods relate to a curtain configured decorative lighting system. The curtain configuration of decorative light stings is obtained by using light-string distribution elements, each of which receives an input signal by a conductive lead. The input signal is indicative of a plurality of lighting commands. The light-string distribution element then provides an output signal to a tap connector, to which a decorative light string can be connected. The provided output signal is indicative of lighting commands corresponding to a plurality of lighting elements distributed along the decorative light string connected thereto. The plurality of lighting elements of the attached decorative light string each illuminate in response to one of the lighting commands indicated by the output signal. In some embodiments, the decorative light string provides to the tap connector a signal indicative of lighting commands that do not correspond to lighting elements of that decorative light string.

19 Claims, 14 Drawing Sheets

(56) References Cited

U.S. PATENT DOCUMENTS

| | | | | |
|---|---|---|---|---|
| 8,941,312 | B2 | 1/2015 | McRae | |
| 8,988,013 | B2 | 3/2015 | McRae | |
| 9,007,000 | B2 | 4/2015 | Szczeszynski et al. | |
| 9,089,030 | B2 | 7/2015 | Neuman | |
| 9,258,861 | B2 | 2/2016 | Chu et al. | |
| 9,313,846 | B2 | 4/2016 | Chen et al. | |
| 9,374,857 | B2 | 6/2016 | McRae et al. | |
| 9,523,486 | B2 * | 12/2016 | Boyink ..... | H05B 33/0857 |
| 2014/0035481 | A1 | 2/2014 | Peting et al. | |
| 2015/0084515 | A1 | 3/2015 | Altamura et al. | |
| 2015/0359066 | A1 | 12/2015 | Loomis | |

* cited by examiner

DATA/POWER CONTROLLER FOR TRANSLATION BETWEEN LIGHT CONTROL PROTOCOLS

CROSS-REFERENCE TO RELATED APPLICATION(S)

This application is a continuation in part of U.S. patent application Ser. No. 15/967,184 entitled "Curtain-Configured Light Strings" filed Apr. 30, 2018 by Jason Loomis and Jared William Everline, which in turn is a continuation-in-part of U.S. patent application Ser. No. 15/484,847, entitled "Long-Chain-Tolerant Decorative Strings of Independently Illumination Controllable LEDs" filed Apr. 11, 2017 by Jason Loomis and Jared William Everline, which are hereby incorporated by reference.

BACKGROUND

Decorative light strings are used to communicate a joy of a holiday season, to draw attention to merchandise, or to simply decorate or adorn an object. Decorative light strings can be used both indoors and outdoors. Decorative light strings have been used residentially to adorn trees, shrubs, and houses. Commercial businesses can use decorative light strings to provide festive atmospheres at their places of business.

Some such decorations can involve many decorative light strings. These light strings are often connected in series fashion. Series-connected decorative light strings receive their operating power from a connector at a first end and deliver power to strings connected to a second end of the decorative light string. Thus, a first decorative light string in a series-connected chain of decorative light strings carries the operating current for the entire series-connected chain of decorative light strings. Conversely, a last decorative light string in the series-connected chain will only carry the operating current for that last decorative light string.

Light strings traditionally have been constructed using incandescent bulbs. Light strings that use incandescent bulbs often have been powered using AC line voltages. In more recently times, Light Emitting Diodes (LED) have been used in light strings. LEDs usually require low-voltage DC power for illumination. Therefore, decorative light strings that use LEDs can be powered by low-voltage power levels. Providing a low-voltage power level to a series-connected chain of decorative light strings, however, can result in high current levels. Such high current levels can cause voltage droop along the series-connected chain, which in turn can cause the LEDs of the last decorative light string to be noticeably dimmer than the LEDs of the first decorative light string. Thus, a method of providing power to long chains of series-connected LED light strings that minimizes the dimming of the last decorative light string of the chain is desired.

SUMMARY

Apparatus and associated methods relate to a light-string distribution element for a decorative lighting system. The light-string distribution element includes a conductive lead configured to connect to an upstream module of the decorative lighting system. The conductive lead is further configured to receive, from the upstream module connected thereto, operating power. The conductive lead is also configured to receive, from the upstream module connected thereto, an input signal indicative of a plurality of lighting commands. Each of the plurality of lighting commands is configured to cause a particular lighting element to illuminate in a specific manner indicated by that lighting command. The light-string distribution element includes a tap connector configured to connect to a complementary connector of a decorative light string having a plurality of lighting elements. The tap connector is further configured to provide, to the decorative light string connected thereto, operating power received by the conductive lead. The tap connector is further configured to provide, to the decorative light string connected thereto, a first output signal indicative of a first subset of the plurality of lighting commands. The first subset of the plurality of lighting commands corresponds to lighting commands for a plurality of lighting elements of the decorative light sting connected thereto. The light-string distribution element also includes a conductive tail configured to connect to a downstream module. The conductive tail is further configured to provide, to the downstream module connected thereto, operating power received by the conductive lead. The conductive tail is also configured to provide, to the downstream module, a second output signal indicative of a second subset of the plurality of lighting commands. The second subset of lighting commands includes lighting commands for a plurality of lighting elements of other decorative light stings connected via the downstream module Some embodiments relate to a decorative light string that includes a plurality of lighting elements distributed along the decorative light string. Each of the plurality of lighting elements is configured to illuminate in a manner indicated by a light-control signal corresponding to that lighting element. The decorative light string includes a connector configured to receive, from a light-string distribution member connected thereto, operating power. The connector is further configured to receive, from the light-string distribution member connected thereto, an input signal indicative of a plurality of lighting commands. The plurality of lighting commands includes first and second subsets of the plurality of lighting commands. Each of the first subset of the plurality of lighting commands is configured to cause one of the plurality of lighting elements to illuminate in a specific manner indicated by that lighting command. The connector is further configured to provide, to the tap connector, an output signal indicative of the lighting commands of the second subset. The second subset of the plurality of lighting commands includes all lighting commands indicated by the input signal received by the connector except for the first subset of the plurality of lighting commands.

DETAILED DESCRIPTION

Apparatus and associated methods relate to a series-connectable decorative light string. High-voltage power is received via a first electrical connecter at a first end of the decorative light string and is conducted to a complementary second electrical connector at a second end of the decorative light string. The decorative light string has a power converter that converts the received high-voltage power to low-voltage DC power for consumption by a plurality of lighting elements distributed along the decorative light string. Each of the plurality of lighting elements has an illumination controller. The plurality of lighting elements is wired in daisy chain fashion from the first electrical connector to the second electrical connector via data-in and data-out ports of each lighting element. The wire high-voltage power received by the first electrical connector can provide power to additional decorative light strings connected via the second electrical connector without resulting in degraded illumination.

Figure 1:
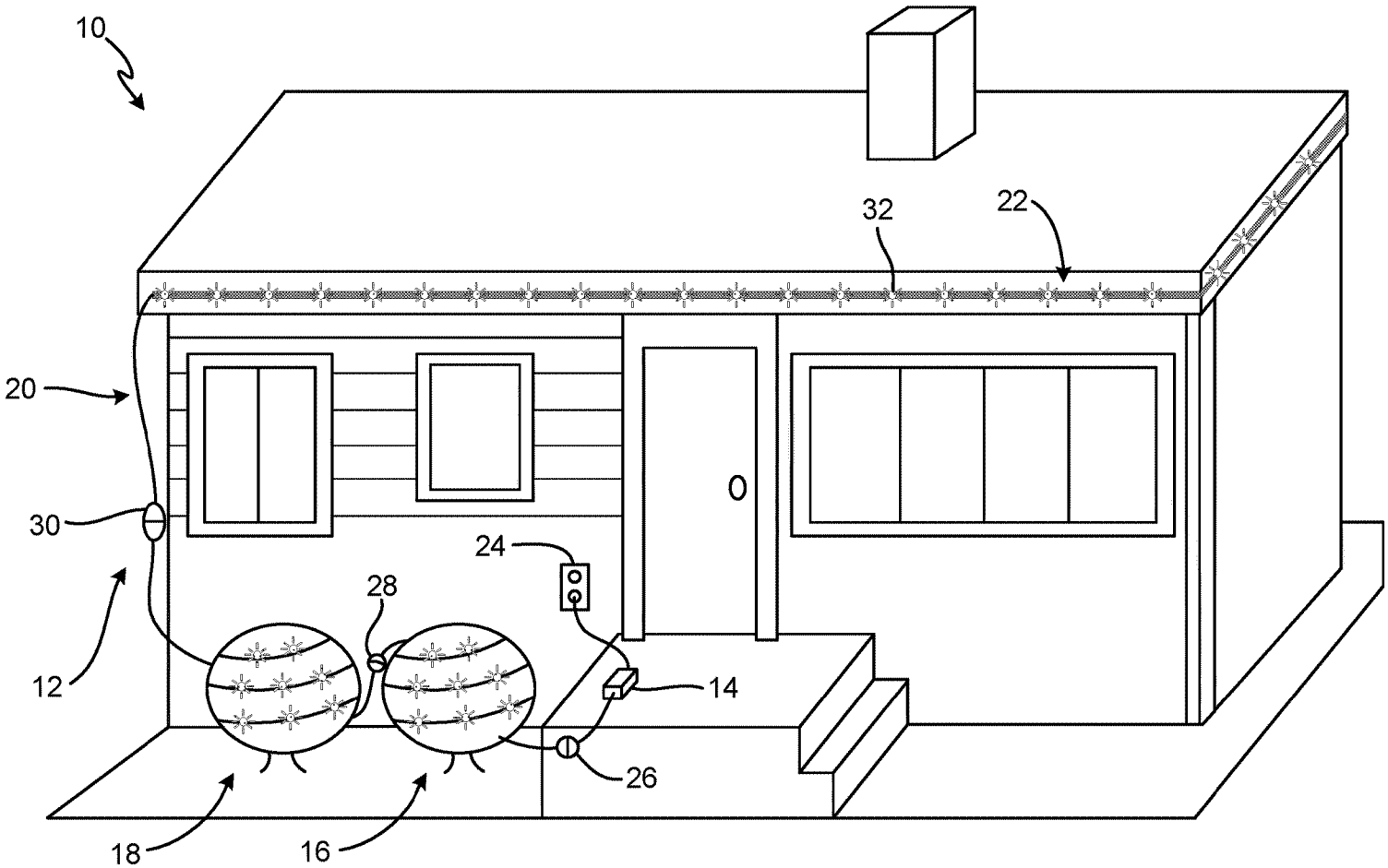
FIG. 1 is a schematic view of a home decorated with long chain of series-connected decorative light strings.

FIG. 1 is a schematic view of a home decorated with long chain of series-connected decorative light strings. In FIG. 1, home 10 is decorated with lighting system 12 for a holiday season. Lighting system 12 includes a power supply 14 and decorative LED light strings 16, 18, 20 and 22. Power supply 14 is plugged into house outlet 24 and draws operating current from standard AC line voltage (e.g., 120 VAC). Decorative light strings 16, 18, 20 and 22 are series connected. First decorative LED light string 16 is connected to power supply 14 via connector pair 26. Second decorative LED light string 18 is connected to first decorative LED light string 16 via connector pair 28. Third decorative LED light string 20 is connected to second decorative LED light string 18 via connector pair 30. Fourth decorative LED light string 22 is connected to third decorative LED light string 20 via connector pair 32. Each of connector pairs 26, 28, 30 and 32 include a connector coupled to a first of the connected elements (e.g., a connector of power supply 14), and a complementary connector coupled to a second of the connected elements (e.g., a connector of first decorative light string 16).

Operating power for decorative LED light strings 16, 18, 20 and 22 is provided by power supply 14. In some embodiments, power supply 14 converts power from standard AC line voltage to a form compatible with LED light strings 16, 18, 20 and 22. For example, in an exemplary embodiment power supply 14 converts 120 VAC power to high-voltage DC power. In other embodiments, however, decorative light strings 16, 18, 20 and 22 can be made to be compatible with 120 VAC. In such embodiments, power supply 14 can be omitted, and first decorative LED light string 16 can be directly plugged into house outlet 24. Regardless of the specific power configuration, the chain of series-connected decorative LED light strings 16, 18, 20 and 22 is supplied operating power, both voltage and current, through the connector of connector pair 26 that is coupled to first decorative LED light string 16.

All operating current for decorative LED light strings 16, 18, 20 and 22 will be conducted through connector pair 26 in lighting system 12 as depicted in FIG. 1. Connector pair 28 will conduct operating current for decorative LED light strings 18, 20 and 22. Connector pair 30 will conduct operating current for decorative LED light strings 20 and 22. Connector pair 32 will conduct operating current only for decorative LED light strings 22. Operating power for decorative LED light strings 16, 18, 20 and 22 is calculated as the product of the operating voltage and the operating current. Thus, a specific operating power can be achieved using different voltages and currents. For example, a first power configuration may use high operating current and low operating voltage to achieve a specific operating power, while a second power configuration may use a lower operating current a higher operating voltage.

Although both the first and second power configurations achieve the same operating power, the current differences can have secondary consequence. Because the operating current for light strings 16, 18, 20 and 22 is conducted through connector pair 26, a voltage drop will occur across connector pair 26, as connector pair 26 has a non-zero parasitic resistance associated with connector pair 26. Furthermore, a voltage drop will occur across both decorative LED light sting 16 and connector pair 28 due to parasitic resistances, as a result of conduction therethrough of operating current for lights strings 18, 20 and 22. The first power configuration, which achieves the specific operating power using high operating currents will have larger voltage drops across lighting elements 26, 16, 28, etc. than will the second power configuration which achieves the same specific operating power but uses lower operating currents. Use of high-voltage/low-current power configurations can permit the use of long chains of series-connected decorative LED light strings.

Figure 2:
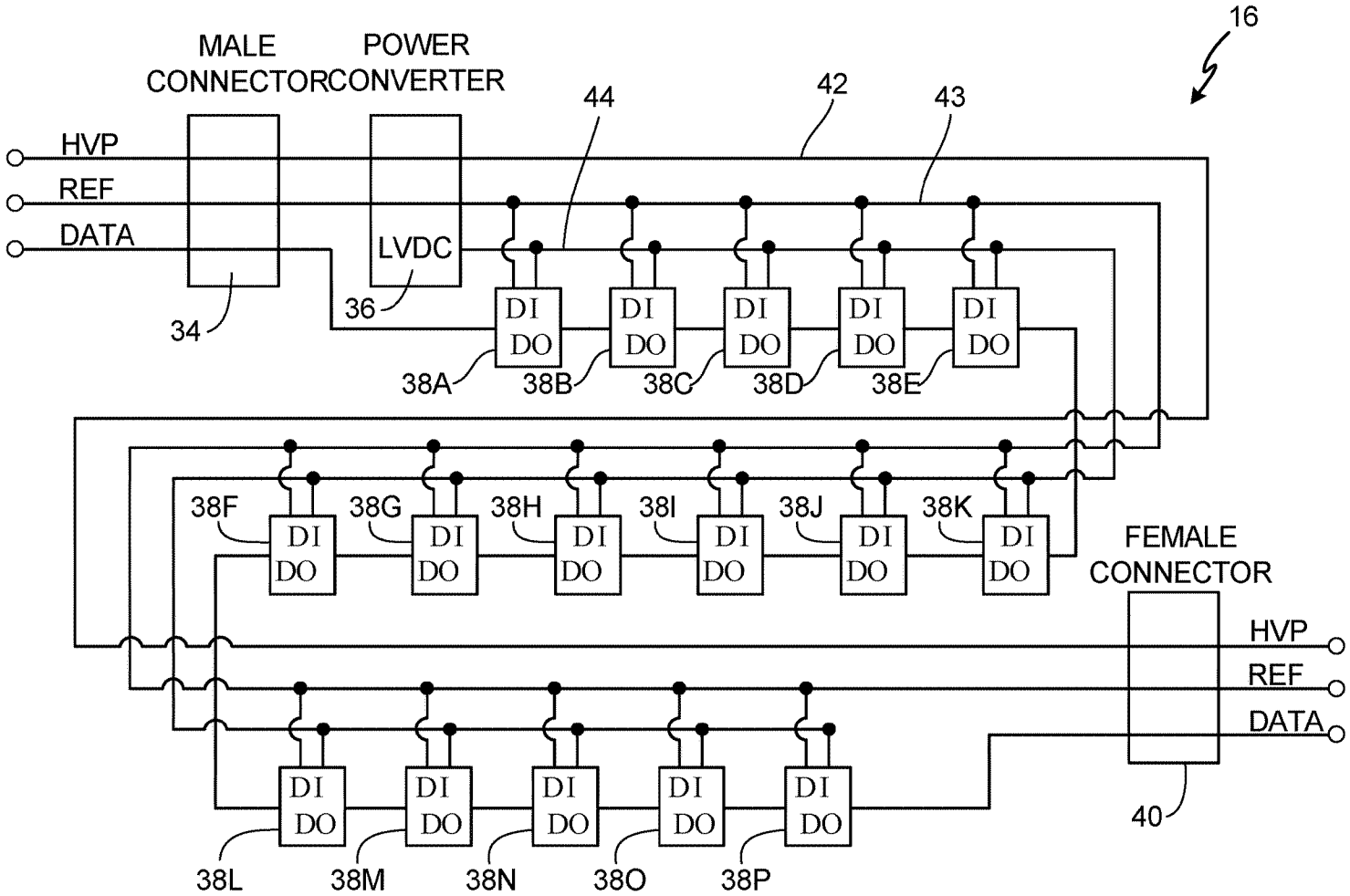
FIG. 2 is a schematic diagram of an exemplary long-chain-tolerant decorative LED light string.

FIG. 2 is a schematic diagram of an exemplary long-chain-tolerant decorative LED light string. In FIG. 2, decorative LED light string 16 of FIG. 1 is shown in schematic form. Decorative LED light string 16 includes first connector 34, power converter 36, lighting elements 38A-38P, and second connector 40. First connector 34 is labeled as MALE CONNECTOR, and second connector 40 is labeled as FEMALE CONNECTOR in the depicted embodiment. Various embodiments can have various configurations of connectors. To facilitate series connectivity of multiple decorative LED light stings, however, first connector 34 and second connector 40 are complementary connectors. Connectors are complementary when they mate or engage with one another. Thus, first connector 34 of a subsequent and decorative LED light string (and perhaps identical to decorative LED light string 16, e.g., decorative light string 18 depicted in FIG. 1) can mate or engage with second connector 40 of decorative LED light string 16 depicted in FIGS. 1 and 2, if first connector 34 and second connector 40 are complementary to one another.

In the depicted embodiment connectors 34 and 40 each has three contacts. First connector 34 has contacts labeled: i) high-voltage power HVP; ii) power reference REF; and iii) and data-in DATA. Second connector 40 has contacts labeled: i) high-voltage power HVP; ii) power reference REF; and iii) data-out DATA. Contacts HVP and REF of first connector 34 receive operating power for decorative LED light string 16. Conductors 42 and 43 provide electrical conduction of the received operating power to both power converter 36 and second connector 40. Second connector 40 thereby provides operating power to one or more additional decorative LED light string attached thereto.

Power converter 36 converts the received high-voltage power to a low-voltage DC power suitable for consumption by lighting elements 38A-38P. In some embodiments, the received high-voltage power is 120 VAC line power. In such embodiments, power converter 36 converts the received 120 VAC line power to the low-voltage DC power suitable for consumption by lighting elements 38A-38P. In some embodiments, the received high-voltage power is a high-voltage DC power. For example, in an exemplary embodiment, power supply (depicted in FIG. 1) converts 120 VAC line power to high-voltage DC power by rectifying and filtering the 120 VAC line power. In such embodiments, power converter 36 converts the received high-voltage DC power to the low-voltage DC power suitable for consumption by lighting elements 38A-38P. In still other embodiments, power converter 36 is configured to convert power from other high-voltage power specifications to the low-voltage DC power suitable for consumption by lighting elements 38A-38P.

In the depicted embodiment, power converter 36 provides the low-voltage DC power suitable for consumption by lighting elements 38A-38P on conductor 44. In the depicted embodiment, the converted low-voltage DC power provided to conductor 44 is referenced to power reference REF of conductor 42. Conductors 43 and 44 provide the converted low-voltage DC power to each of lighting elements 38A-38P. In some embodiments, the converted low-voltage DC power will have an isolated reference, independent of power reference REF of conductor 43. In such embodiments, an additional conductor will provide the isolated reference voltage to lighting elements 38A-38P. In such embodiments, the additional conductor along with conductor 44 can provide the converted low-voltage DC power to each of lighting elements 38A-38P.

Lighting elements 38A-38P are identical to one another in the depicted embodiment. Lighting elements 38A-38P are wired in daisy chain fashion from the data-in contact of first connector 34 to the data-out contact of second connector 40 via data-in DI and data-out DO ports of lighting elements 38A-38P. First connector 34 receives illumination control data on the data-in contact of first connector 34. The received illumination control data can independently control the illumination of each of lighting elements 38A-38P, as well as independently controlling lighting elements of one or more decorative LED light strings attached to second connector 40. The received illumination control data may include brightness control, color control, and/or temporal control (e.g., flashing or other temporal lighting variations).

Each of daisy-chained lighting elements 38A-38P receives the illumination control data at data-in port DI. Each of daisy-chained lighting elements 38A-38P then process the received illumination control data and control the illumination based on the received illumination control data. The received illumination control data includes data corresponding to the lighting element that receives the data as well as data corresponding to lighting elements downstream the daisy chain of lighting elements from the lighting element that receives the data. Thus, each of the daisy-chained lighting elements 38A-38P transmits at least some of the received illumination data to downstream lighting elements via the data-out port DO of the lighting element.

Figure 3:
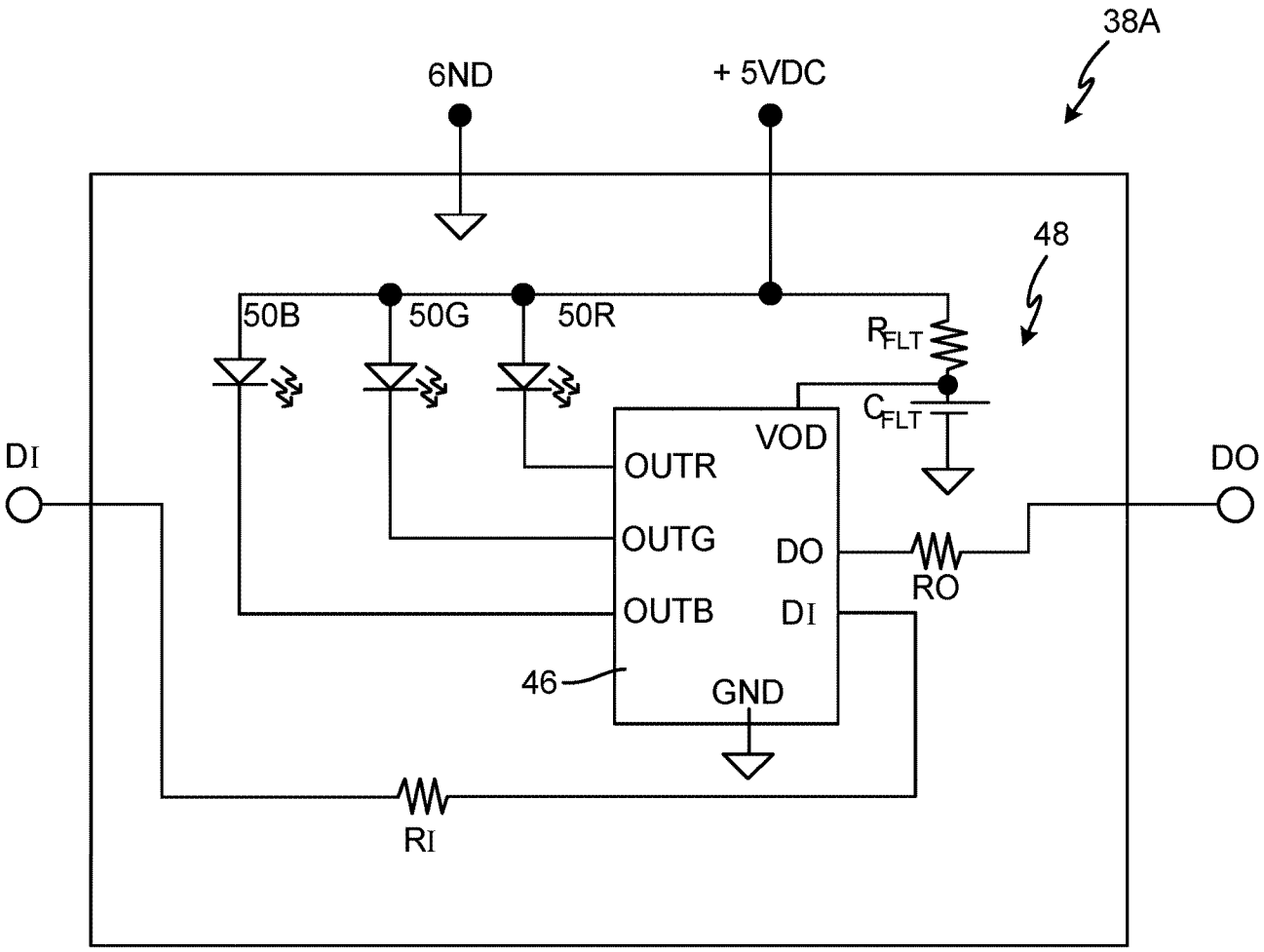
FIG. 3 is a circuit schematic diagram of an exemplary lighting element of a long-chain-tolerant decorative LED light string.

FIG. 3 is a circuit schematic diagram of an exemplary lighting element of a long-chain-tolerant decorative LED light string. In FIG. 3, lighting element 38A of FIG. s is shown in schematic form. Lighting element 38A includes data-in port DI, data-out port DO, ground port GND, low-voltage DC, and power port +5 VDC. Lighting element 38A also includes illumination controller 46, resistors RI and RO, power filter 48, and LEDs 50R, 50G and 50B. In the depicted embodiment, power filter 40 includes resistor $R_{FLT}$ and capacitor $C_{FLT}$. In various embodiments, various power filters can be used. For example, in some embodiments, an inductor can be used in addition to or replacing resistor $R_{FLT}$. In an exemplary embodiment, no power filter is used.

Illumination controller 46 has pins: i) power VDD; ii) ground GND; iii) data-in DI; iv) data-out DO; v) red LED control OUTR; vi) green LED control OUTG; and vii) blue LED control OUTB. LEDs 50R, 50G and 50B each have cathodes that are electrically connected both to one another and to the low-voltage DC power (e.g., +5 VD in the depicted embodiment). Illumination controller 46 controls currents flowing through each of LEDs 50R, 50G and 50B via control pins OUTR, OUTG and OUTB, respectively. Illumination controller 46 controls the currents flowing through LEDs 50R, 50G and 50B based on the illumination control data received on the data-in port DI of lighting element 38A and electrically conducted to the data-in pin DI of illumination controller 46.

In various embodiments, lighting elements 38A-38P can include various configurations of LEDs. For example, in an exemplary embodiment lighting elements 38A-38P can include a red LED, a green LED, and a blue LED. In some embodiments, lighting elements 38A-38P can include other types of LEDs, such as, for example, warm white, pure white, ultra-violet (UV), deep blue, and/or amber LEDs. Such types of LEDs can be including alone or in various combinations in lighting elements 38A-38P.

In various embodiments, illumination controller 46 controls the illumination color, brightness, temporal pattern of illumination. For example, illumination controller 46 can control color by controlling the relative intensities of the red, green and blue light illuminated by LEDs 50R, 50G and 50B, respectively. Illumination controller 46 can control brightness by controlling the absolute intensity of the combination of red, green and blue light illuminated by LEDs 50R, 50G and 50B, respectively. Illumination controller 46 can control the temporal pattern of illumination by temporally changing these relative and absolute intensities as a function of time.

Figure 4:
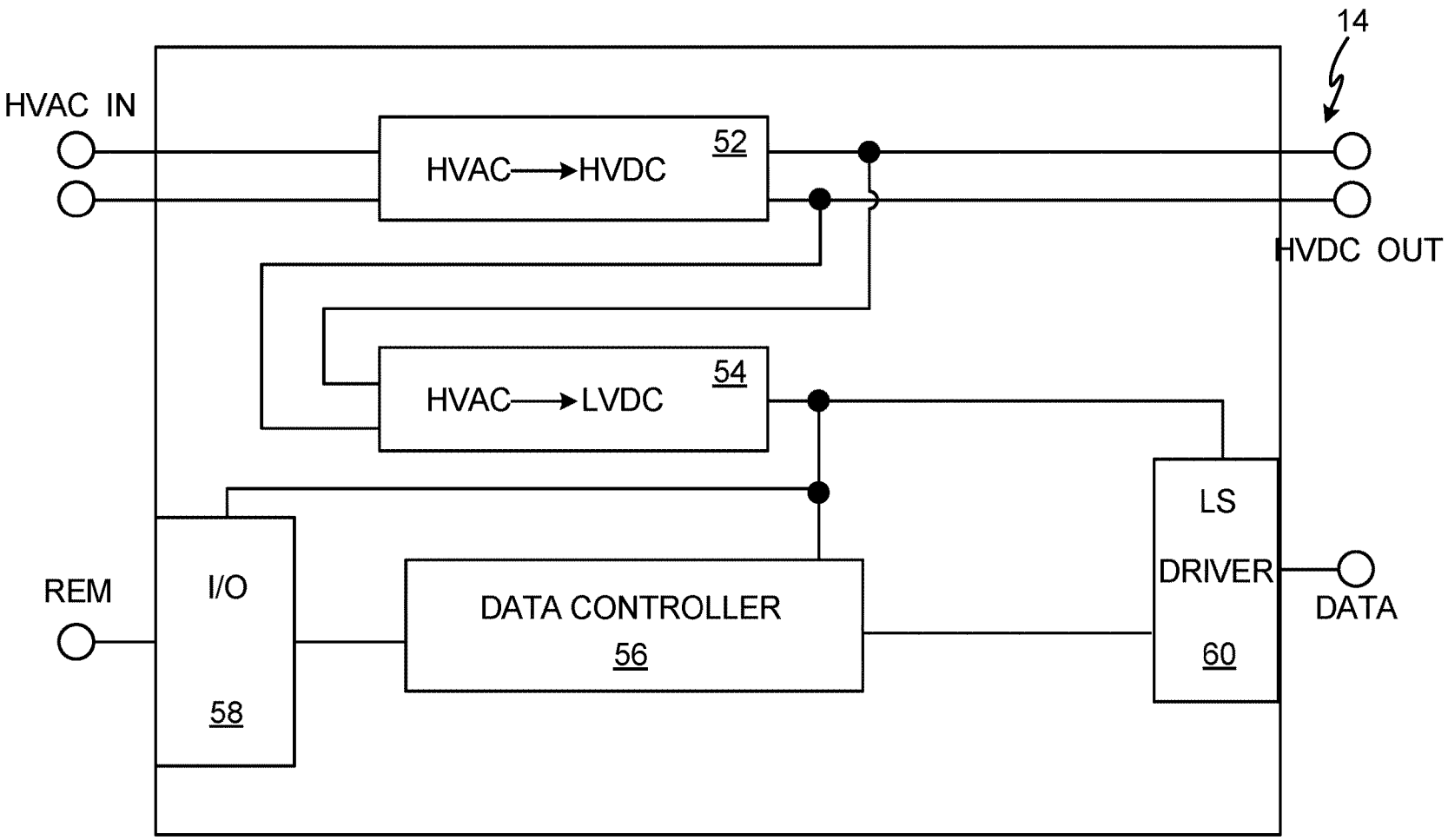
FIG. 4 is a circuit schematic of an exemplary power supply for a long chain of decorative LED light strings.

FIG. 4 is a block schematic of an exemplary power supply for a long chain of decorative LED light strings. In FIG. 4, exemplary power supply 14 depicted in FIG. 1 is shown in block diagram form. Power supply 14 high-voltage AC/high-voltage DC converter, 52, high-voltage DC/low-voltage DC converter 54, data controller 56, input/output interface 58 and light-string driver 60. Power supply 14 also has high-voltage AC input port HVAC_IN, high-voltage DC output port HVDC_OUT, remote data input port REM, and light-string data output port DATA.

High-voltage AC/high-voltage DC converter 52 received high-voltage AC power from high-voltage AC input port HVAC_IN. High-voltage AC/high-voltage DC converter 52 converts the received high-voltage AC power to high-voltage DC power and provide the converted high-voltage DC power to a connected chain of light strings via high-voltage DC output port HVDC_OUT, and provides the converted high-voltage DC power to high-voltage DC/low-voltage DC converter 54. High-voltage DC/low-voltage DC converter 54 converts the received high-voltage DC power to low-voltage DC power and provides the converted low-voltage DC power to each of data controller 56, input/output interface 58 and light-string driver 60.

Data controller 56 generates an illumination control signal and provides it to the connected chain of light strings via light-string data output port DATA. Data controller may store data corresponding to various illumination patterns, and/or may receive various illumination patterns from a remote pattern generator via input/output interface 58.

Figure 5:
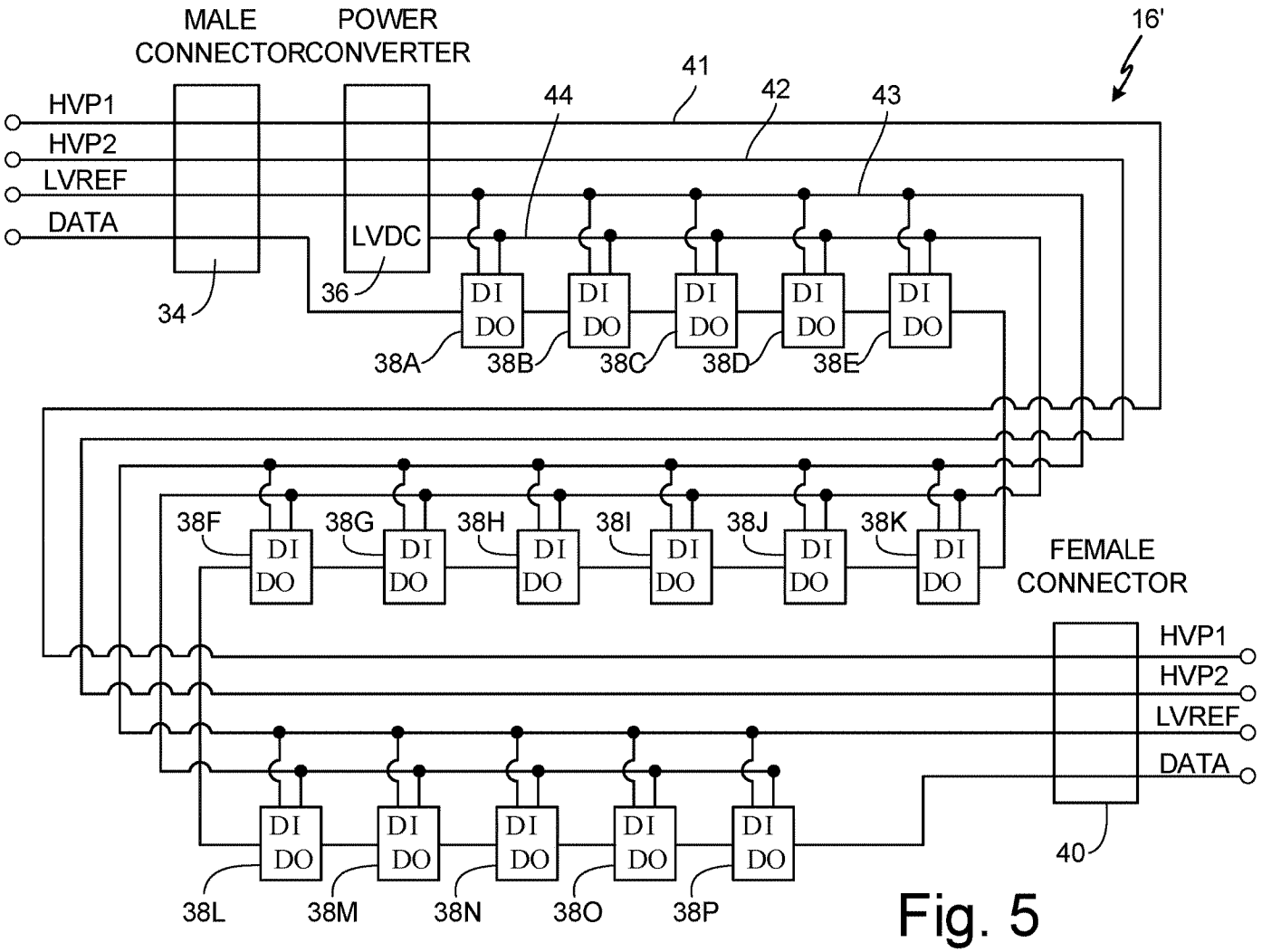
FIG. 5 is a schematic diagram of an exemplary long-chain-tolerant decorative LED light string with separate high-voltage and low-voltage references.

FIG. 5 is a schematic diagram of an exemplary long-chain-tolerant decorative LED light string with separate high-voltage and low-voltage references. Decorative LED light sting 16' depicted in FIG. 5 is the same as Decorative LED light string 16 shown in FIG. 2, except that it has one additional electrical conductor. In the depicted embodiment connectors 34 and 40 each has four contacts. First connector 34 has contacts labeled: i) first high-voltage power HVP1; ii) second high-voltage power HVP2; iii) low-voltage reference LVREF; and iv) and data-in DATA. Second connector 40 has contacts labeled: i) first high-voltage power HVP1; ii) second high-voltage power HVP2; iii) low-voltage reference LVREF; and iv) data-out DATA. Contacts HVP1 and HVP 2 of first connector 34 receive operating power for decorative LED light string 16. Conductors 41 and 42 provide electrical conduction of the received high-voltage operating power to both power converter 36 and second connector 40. Second connector 40 thereby provides operating power to one or more additional decorative LED light string attached thereto.

Power converter 36 converts the received high-voltage power to a low-voltage DC power suitable for consumption by lighting elements 38A-38P. In some embodiments, the received high-voltage power is 120 VAC line power. In such embodiments, power converter 36 converts the received 120 VAC line power to the low-voltage DC power suitable for consumption by lighting elements 38A-38P. In some embodiments, the received high-voltage power is a high-voltage DC power. For example, in an exemplary embodiment, power supply (depicted in FIG. 1) converts 120 VAC line power to high-voltage DC power by rectifying and filtering the 120 VAC line power. In such embodiments, power converter 36 converts the received high-voltage DC power to the low-voltage DC power suitable for consumption by lighting elements 38A-38P. In still other embodiments, power converter 36 is configured to convert power from other high-voltage power specifications to the low-voltage DC power suitable for consumption by lighting elements 38A-38P.

In the depicted embodiment, power converter 36 provides the low-voltage DC power suitable for consumption by lighting elements 38A-38P on conductors 43 and 44. In the depicted embodiment, the converted low-voltage DC power provided to conductors 43 and 44 is referenced to power reference REF of conductor 43. Conductors 43 and 44 provide the converted low-voltage DC power to each of lighting elements 38A-38P. In the depicted embodiment, the converted low-voltage DC power has an isolated reference from the high-voltage power received on conductors 41 and 42.

Figure 6:
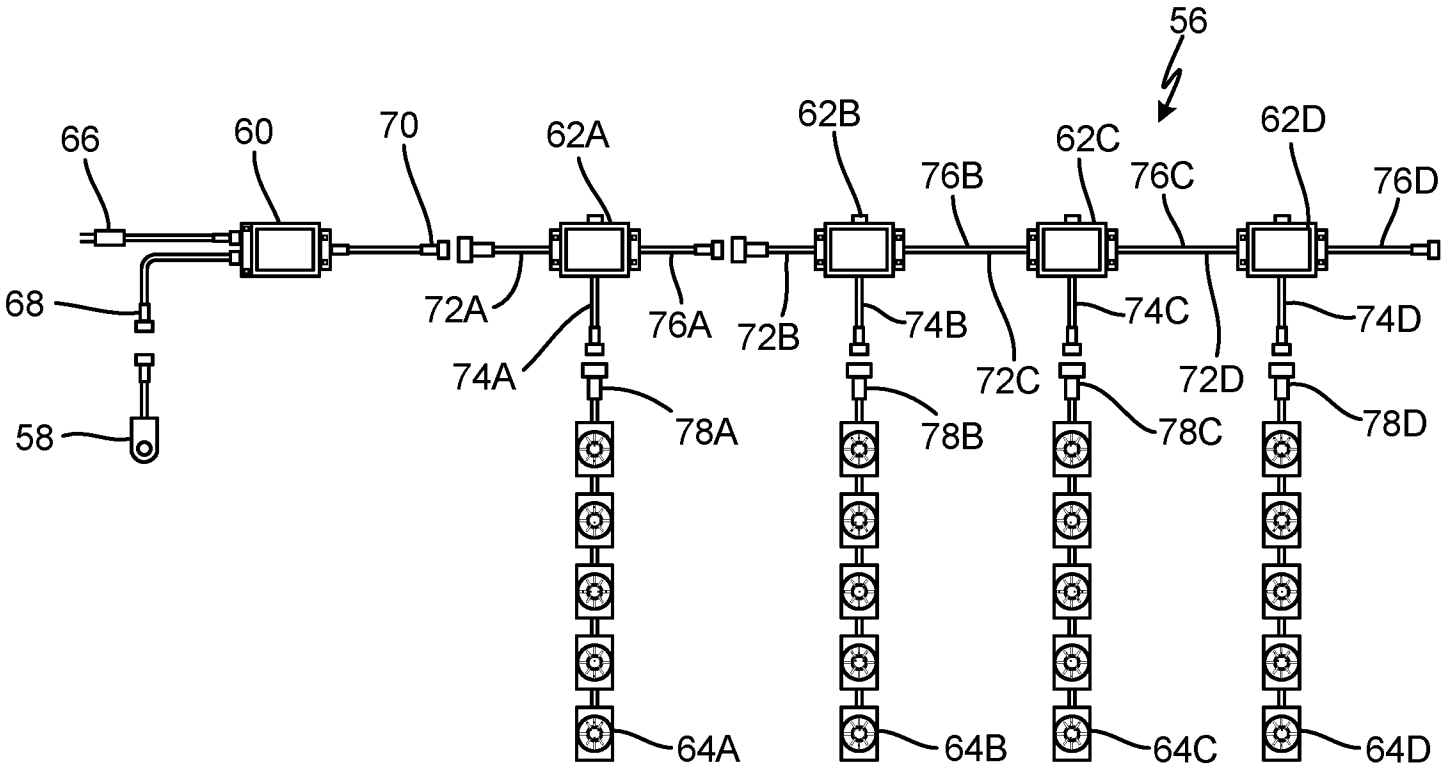
FIG. 6 is a schematic diagram of an embodiment of a curtain configured decorative lighting system.

FIG. 6 is a schematic diagram of an embodiment of a curtain configured decorative lighting system. In FIG. 6, decorative lighting system 56 includes system controller 58, power adaptor 60, light-string distribution members 62A, 62B, 62C and 62D, decorative light strings 64A, 64B, 64C and 64D. Decorative lighting system 56 is curtain configured, because decorative light strings 64A, 64B, 64C and 64D are connect in a curtain fashion to a figurative curtain rod fashioned from light-string distribution members 62A, 62B, 62C and 62D. Lighting system controller 58 generates a signal indicative of a plurality of lighting commands. For example, lighting system controller 58 can generate a signal to cause 100 lighting elements to be illuminated in a fashion in which alternating lights are of different colors. Lighting system controller 58 can cause some of the 100 lighting elements to flash on and off in a predetermined temporal fashion. Light string controller 58 can cause the 100 lights to change their colors in a temporal fashion. Lighting system controller 58 can be programmed to store and retrieve various programs of lighting shows to be used for various lighting configurations.

Power adapter 60 includes power connector 66, lighting controller connector 68 and light connector 70. In some embodiments, power adapter 60 receives AC power via power connector 66 and converts the received AC power to high-voltage DC power. The converted high-voltage DC power is provided, via light connector 70, to light-string distribution members 62A, 62B, 62C and 62D, decorative light strings 64A, 64B, 64C and 64D as operating power. In some embodiments, power adapter 60 receives, via lighting controller connector 68, the signal indicative of a plurality of lighting commands generated by lighting system controller 58. Power adapter 60 then provides the received signal indicative of a plurality of lighting commands to light-string distribution members 62A, 62B, 62C and 62D, decorative light strings 64A, 64B, 64C and 64D via lighting connector 70.

Each of light-string distribution members 62A, 62B, 62C and 62D, has conductive lead 72A, 72B, 72C and 72D, tap connector 74A, 74B, 74C and 74D and conductive tail 76A, 76B 76C and 76D, respectively. In some embodiments, conductive leads 72A, 72B, 72C and 72D and/or conductive tails 76A, 76B 76C and 76D have a connector attached thereto. In some embodiments, conductive leads 72A, 72B, 72C and 72D and/or conductive tails 76A, 76B 76C and 76D have no connector attached thereto. In such embodiments, the light-string distribution members are fixedly attached to one another.

Conductive leads 72A, 72B, 72C and 72D are each configured to connect to an upstream module of decorative lighting system 56. The upstream module is the lighting element on the power adapter side of and to which is attached light-string distribution members 72A, 72B, 72C and 72D. For example, power adapter 60 is the upstream module to which light-string distribution member 72A is connected. Light-string distribution member 72A is the upstream module to which light-string distribution member 72B is attached. Light-string distribution member 72B is the upstream module to which light-string distribution member 72C is attached. Finally, Light-string distribution member 72C is the upstream module to which light-string distribution member 62D is attached.

Conductive tails 76A, 76B, 76C and 76D are each configured to connect to a downstream module of decorative lighting system 56. The downstream module is the lighting element away from the power adapter side of light-string distribution members 72A, 72B, 72C and 72D. For example, light-string distribution member 72B is the downstream module to which light-string distribution member 72A is attached. Light-string distribution member 72C is the downstream module to which light-string distribution member 72B is attached. Light-string distribution member 72D is the downstream module to which light-string distribution member 72C is attached. Finally, Light-string distribution member 72D is not attached to a downstream module.

Each of decorative light strings 64A, 64B, 64C and 64D has a plurality of lighting elements as indicated in the drawing. Decorative light strings 64A, 64B, 64C and 64D have connectors 78A, 78B, 78C and 78D configured to connect to tap connectors 74A, 74B, 74C and 74D of light-string distribution members 62A, 62B, 62C and 62D, respectively. Each of connectors 78A, 78B, 78C and 78D is configured to connect to receive, from light-string distribution members 62A, 62B, 62C and 62D, operating power.

Each of connectors 78A, 78B, 78C and 78D is also configured to connect to receive, from light-string distribution members 62A, 62B, 62C and 62D, an input signal indicative of a plurality of lighting commands. The plurality of lighting commands includes lighting commands for each of the plurality of lighting elements of that decorative light string 62A, 62B, 62C and 62D to which it pertains as well as lighting commands for the plurality of lighting elements of decorative lights strings 62B, 62C and 62D downstream. For example, decorative light string 64C receives, via connector 78C, lighting command for itself as well as lighting commands for decorative light string 64D. Decorative light string 64B receives, via connector 78B, lighting command for itself as well as lighting commands for decorative light strings 64C and 64D. Decorative light string 64A receives, via connector 78A, lighting command for itself as well as lighting commands for decorative light strings 64B, 64C and 64D.

The plurality of lighting elements of each of decorative light strings 64A, 64B, 64C and 64D receives, via a data-in port, the input signal received by connectors 78A, 78B, 78C and 78D. In some embodiments the input signal includes a time sequence of sub-signals, each of which indicative one of the plurality of lighting commands indicated by the input signal. Each of the plurality of lighting elements responds in accordance with the lighting command indicated by the first of the received sub-signals passed thereto, and transmits, via a data-out port, the sub-signals following the first of the received lighting commands. Thus, a train of lighting commands is sequentially provide to the plurality of lighting elements, each element stripping the first sub-lighting command from the train and passing the remaining lighting commands to the lighting element coupled thereto. After the last of the series of lighting elements has received the train of lighting commands, the train of remaining lighting commands is provided, as indicated by an output signal, to connectors 78A, 78B, 78C and 78D so that light-string distribution members 62A, 62B, 62C and 62D can receive these lighting commands and provide them to the downstream module to which light-string distribution members 62A, 62B, 62C and 62D are connected.

Figure 7:
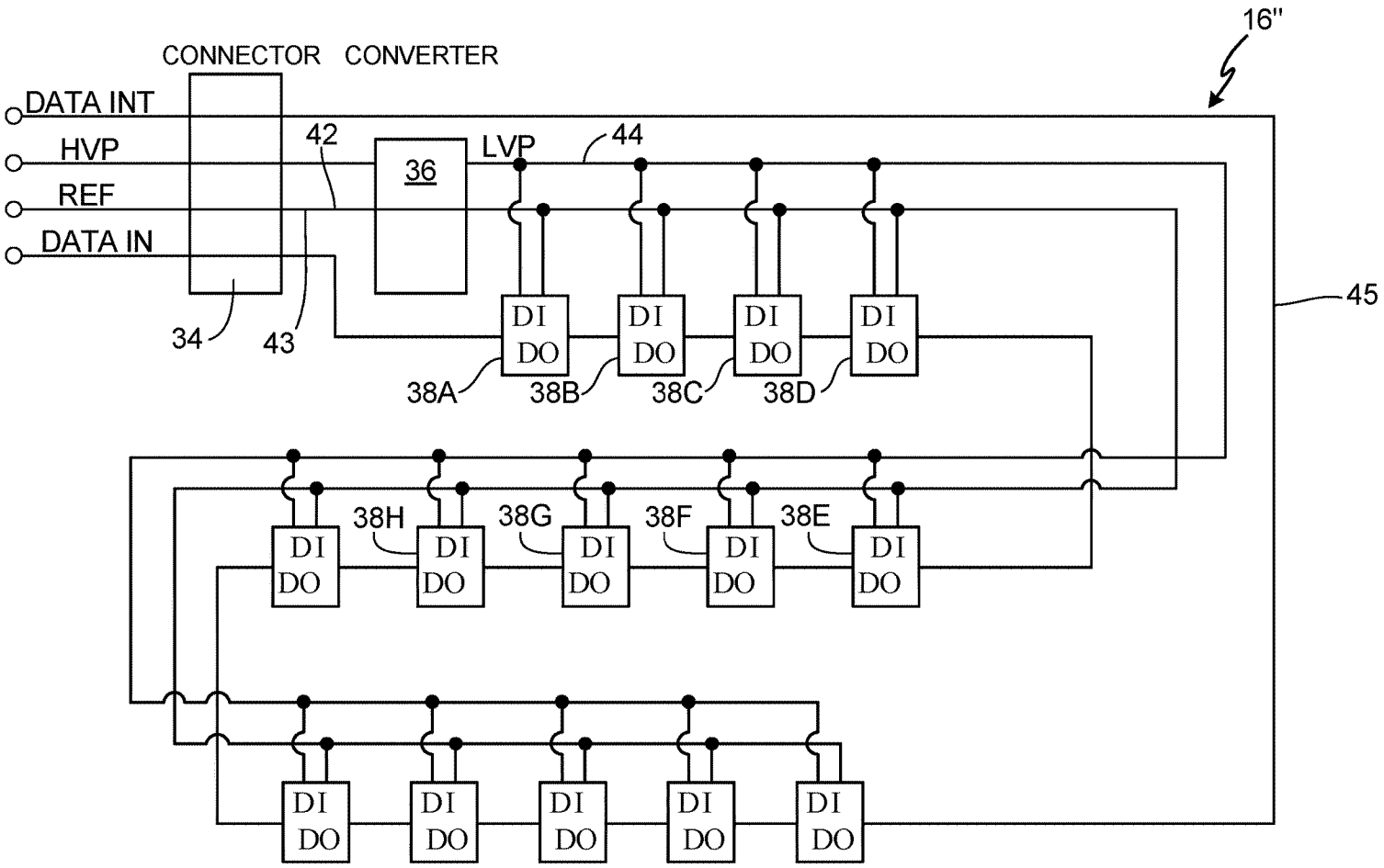
FIG. 7 is a block diagram of an embodiment of a decorative light string configured as a curtain member.

FIG. 7 is a block diagram of an embodiment of a decorative light string configured as a curtain member. In FIG. 7, decorative LED light string 16" includes connector 34, power converter 36, and lighting elements 38A-38P. Some embodiments do not have power converter 36, as such power conversion can be performed in the light-string distribution module to which decorative light string 16" is attached. Connector 34 has four contacts in the depicted embodiment. Connector 34 has contacts labeled: i) high-voltage power (HVP); ii) power reference (REF); iii) data-in; and iv) data-out. Contacts HVP and REF of connector 34 receive operating power for decorative LED light string 16". Conductors 42 and 43 provide electrical conduction of the received operating power to power converter 36.

Power converter 36 converts the received high-voltage power to a low-voltage DC power (LVP) suitable for consumption by lighting elements 38A-38P. In some embodiments, the received high-voltage power is 120 VAC line power. In such embodiments, power converter 36 converts the received 120 VAC line power to the low-voltage DC power suitable for consumption by lighting elements 38A-38P. In some embodiments, the received high-voltage power is a high-voltage DC power. For example, in an exemplary embodiment, power supply (depicted in FIG. 1) converts 120 VAC line power to high-voltage DC power by rectifying and filtering the 120 VAC line power. In such embodiments, power converter 36 converts the received high-voltage DC power to the low-voltage DC power suitable for consumption by lighting elements 38A-38P. In still other embodiments, power converter 36 is configured to convert power from other high-voltage power specifications to the low-voltage DC power suitable for consumption by lighting elements 38A-38P.

In the depicted embodiment, power converter 36 provides the low-voltage DC power suitable for consumption by lighting elements 38A-38P on conductor 44. In the depicted embodiment, the converted low-voltage DC power provided to conductor 44 is referenced to power reference REF of conductor 42. Conductors 43 and 44 provide the converted low-voltage DC power to each of lighting elements 38A-38P. In some embodiments, the converted low-voltage DC power will have an isolated reference, independent of power reference REF of conductor 43. In such embodiments, an additional conductor will provide the isolated reference voltage to lighting elements 38A-38P. In such embodiments, the additional conductor along with conductor 44 can provide the converted low-voltage DC power to each of lighting elements 38A-38P.

Lighting elements 38A-38P are identical to one another in the depicted embodiment. Lighting elements 38A-38P are wired in daisy chain fashion from the data-in contact of first connector 34 to the data-out contact of second connector 40 via data-in DI and data-out DO ports of lighting elements 38A-38P. First connector 34 receives illumination control data on the data-in contact of first connector 34. The received illumination control data can independently control the illumination of each of lighting elements 38A-38P, as well as independently controlling lighting elements of one or more decorative LED light strings attached to second connector 40. The received illumination control data may include brightness control, color control, and/or temporal control (e.g., flashing or other temporal lighting variations).

Each of daisy-chained lighting elements 38A-38P receives the illumination control data at data-in port DI. Each of daisy-chained lighting elements 38A-38P then process the received illumination control data and control the illumination based on the received illumination control data. The received illumination control data includes data corresponding to the lighting element that receives the data as well as data corresponding to lighting elements downstream the daisy chain of lighting elements from the lighting element that receives the data. Thus, each of the daisy-chained lighting elements 38A-38P transmits at least some of the received illumination data to downstream lighting elements via the data-out port DO of the lighting element. The last 38P of the lighting elements 38A-38P outputs the signal indicative of a plurality of lighting commands to conductor 45, which provides the signal indicative of a plurality of lighting commands to connector 34. Connector 34, in turn, provides the signal indicative of a plurality of lighting commands back to a light-string distribution element, to which it is attached.

Figure 8:
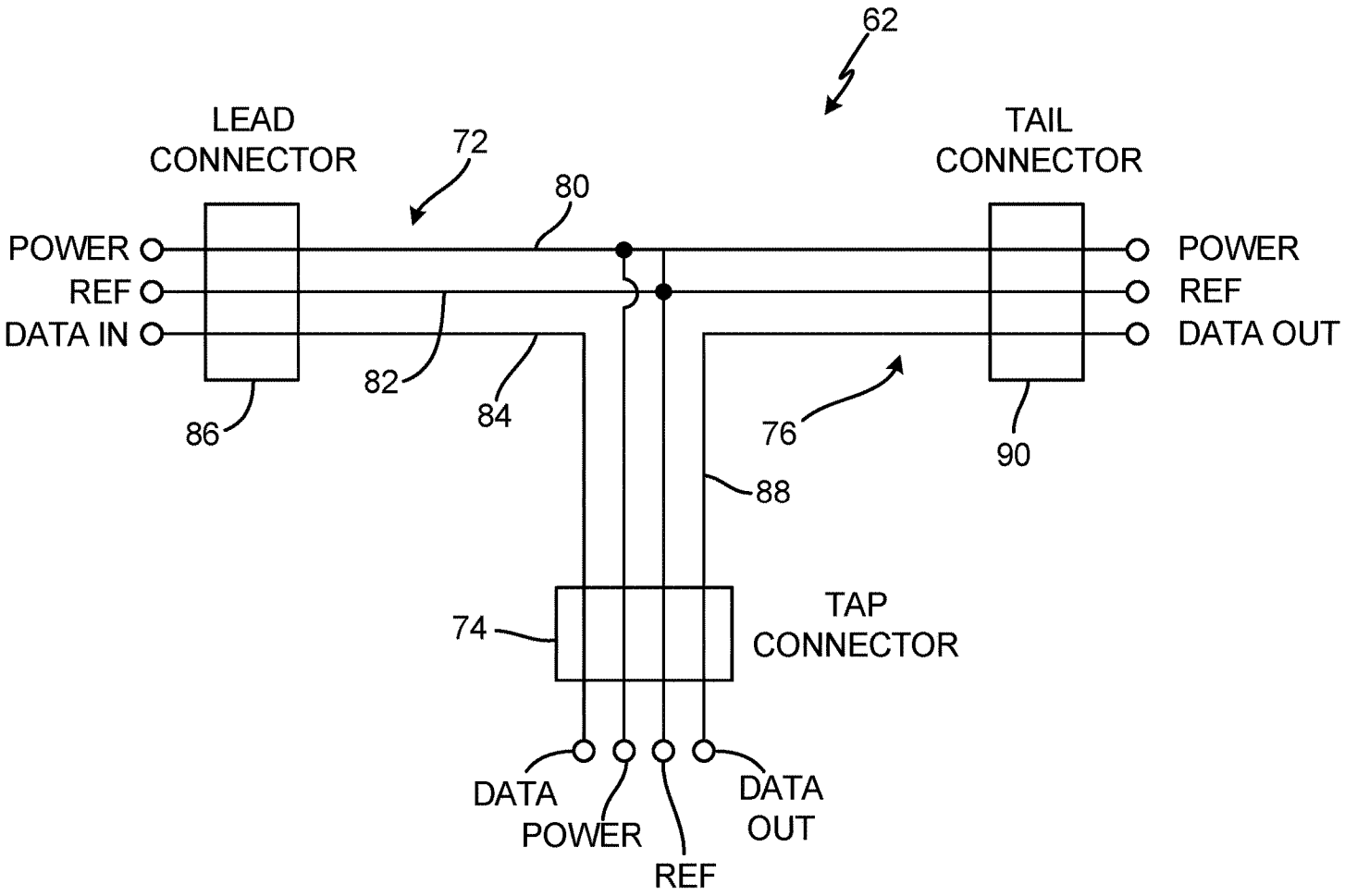
FIG. 8 is a block diagram of an embodiment of a light-string distribution member for use in a curtain configured decorative lighting system.

FIG. 8 is a block diagram of an embodiment of a light-string distribution member for use in a curtain configured decorative lighting system. In FIG. 8, light-string distribution member 62 includes conductive lead 72, tap connector 74 and conductive tail 76. In the depicted embodiment, conductive lead 72 includes three separate conductive wires—power conductor 80, reference conductor 82, and data-in conductor 84. Light-string distribution member 62 has lead connector 86 configured to releasably couple conductors 80, 82 and 84 to an upstream module of a decorative lighting system. In the depicted embodiment, conductive tail 76 includes three separate conductive wires—power conductor 80, reference conductor 82, and data-out conductor 88. Light-string distribution member 62 has tail connector 90 configured to releasably couple conductors 80, 82 and 88 to a downstream module of a decorative lighting system. Tap connector is configured to releasably couple conductors 80, 82, 84 and 88 to a decorative light string attached thereto.

Figure 9:
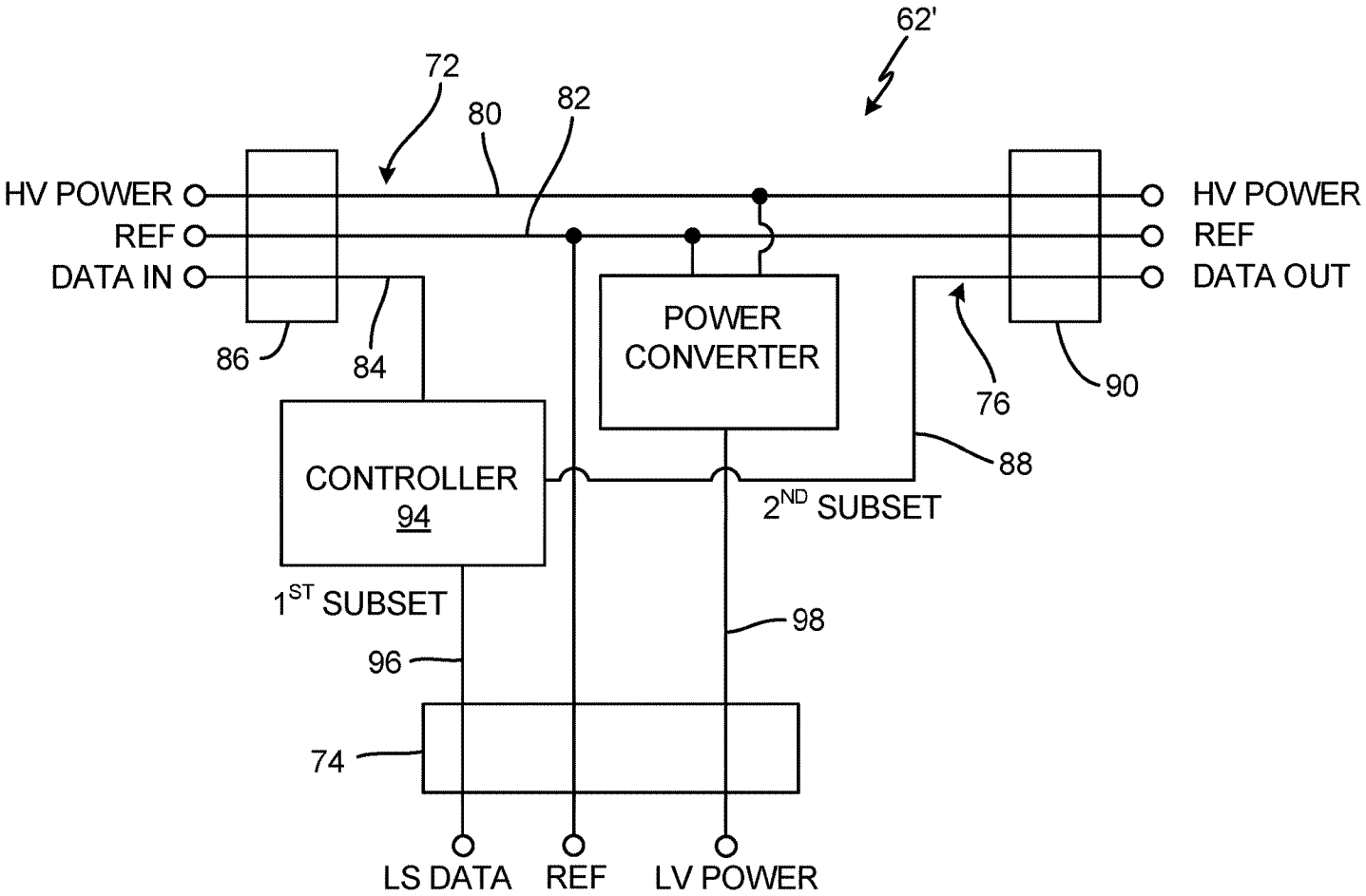
FIG. 9 is a block diagram of another embodiment of a light-string distribution member for use in a curtain configured decorative lighting system.

FIG. 9 is a block diagram of another embodiment of a light-string distribution member for use in a curtain configured decorative lighting system. In FIG. 9, light-string distribution member 62' includes conductive lead 72, tap connector 74, conductive tail 76, power converter 92, and controller 94. In the embodiment depicted, instead of providing the data-in signal, received by conductive lead 72, directly to tap connector 74, the received data-in signal is provided to controller 94. Controller 94 sends, to tap connector 74 via conductor 96, only the sub-signals of the received data-in signal that pertain to the decorative lighting element connected thereto. Controller 94 then sends, to conductive tail 76 via conductor 88, only the sub-signals of the received data-in signal that pertain to decorative lighting elements connected via conductive tail 76. The FIG. 9 embodiment also depicts power converter 92, which converts the power conducted by conductor 80 from high voltage to low voltage. Conductor 98 provides the low-voltage power to tap connector 74 via conductor 98.

Various different protocols can be used to provide both power and data to individually-controllable lighting elements of a decorative lighting system. Above is described a protocol in which power and data are communicated to individually-controllable lighting elements via separate conductors. For example, the FIG. 2 embodiment discloses a three conductor configuration having a power line, a data line, and a reference line shared by both the power and the data lines. Another protocol that can provide both power and data to individually-controllable lighting elements uses only two conductors that are both shared by the data signals and power.

Figure 10A:
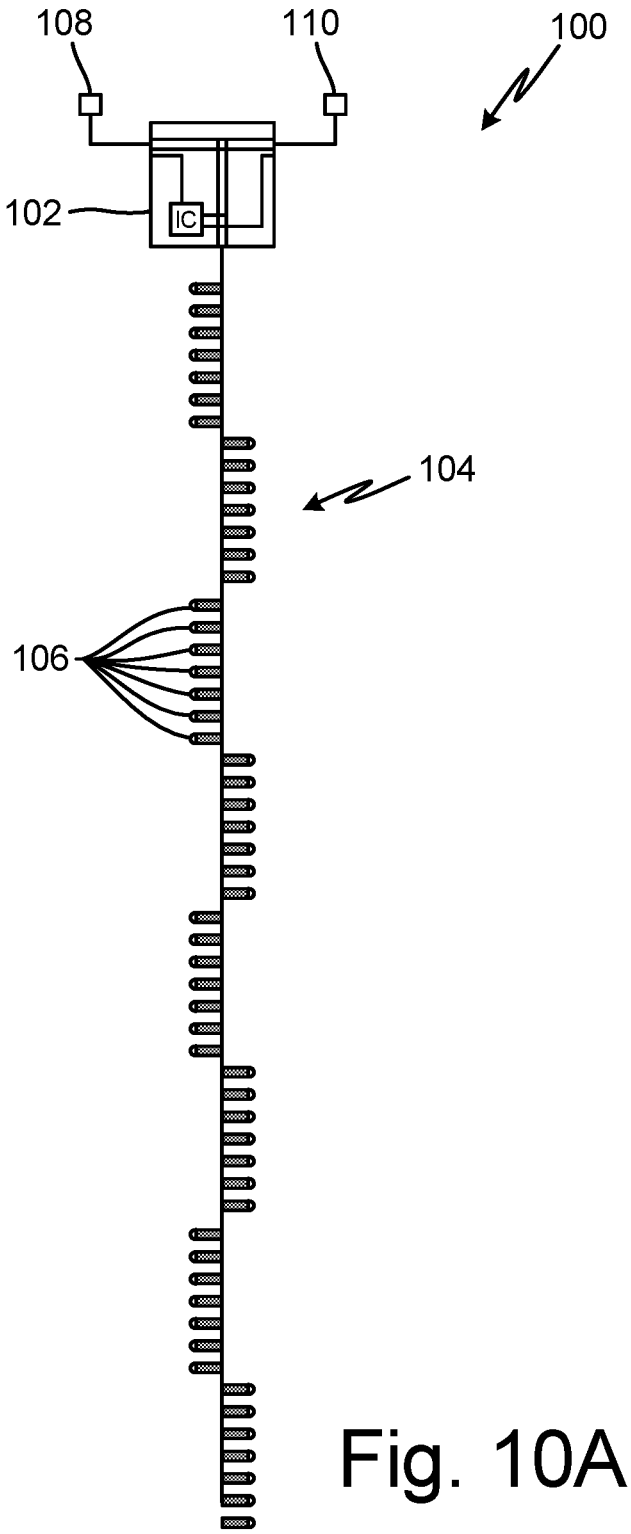
FIGS. 10A-10B are schematic diagrams of decorative lighting modules that have a data/power control for translating between different lighting protocols.
Figure 10B:
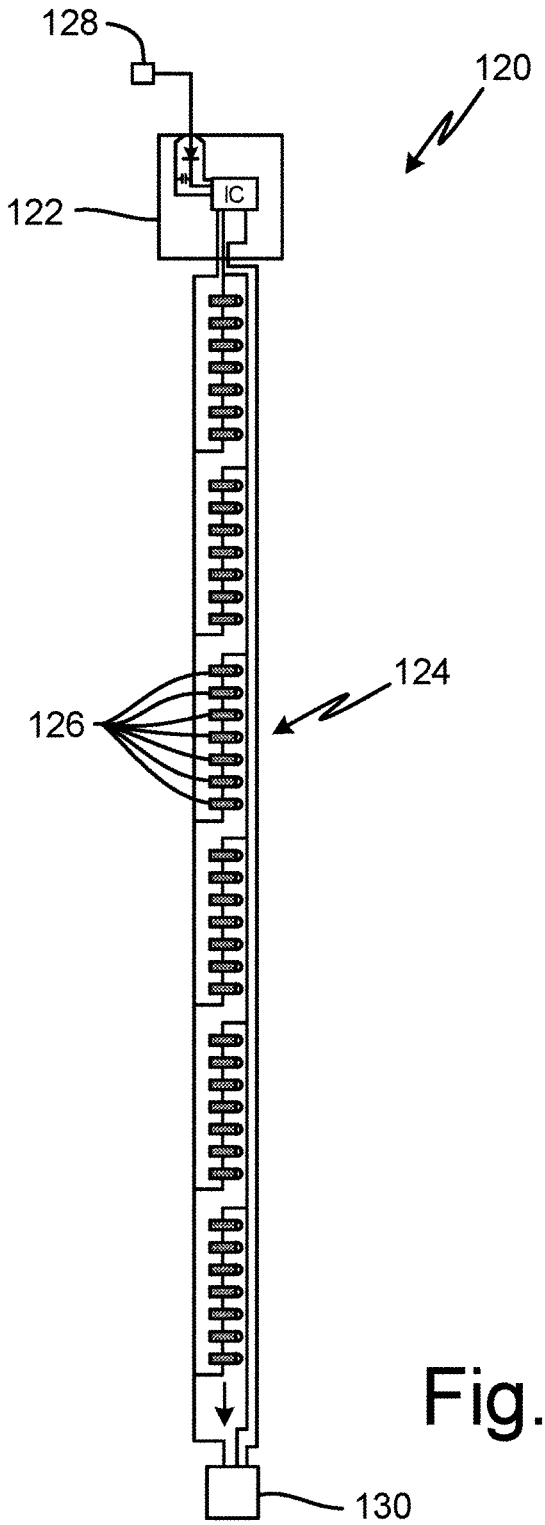

FIGS. 10A-10B are schematic diagrams of decorative lighting modules that have a data/power control for translating between different lighting protocols. FIG. 10A depicts a decorative lighting modules that has both input and output connectors on one end of the decorative lighting modules. Such a decorative lighting modules can be described as an end-in-bulb light string, because the decorative lighting module is configures as a light string having both connectors at a first end and no connector at a second end. Instead of a connector at the second end, the light string ends with a lighting element (e.g., a bulb). In FIG. 10A, decorative lighting modules 100 includes data/power controller 102 and tap lighting display 104. Tap lighting display 104 includes a plurality of individually-controllable lighting elements 106, which can be wired in various fashions. In some embodiments, individually-controllable lighting elements 106 can be wired in series. In other embodiments, individually-controllable lighting elements 106 can be wired in parallel. In still other embodiments, individually-controllable lighting elements 106 can be wired in a series-parallel fashion (e.g., parallel combination of series connected subsets of the individually-controllable lighting elements). In any of these configurations, however, both power and data signals can be provided to the individually-controllable lighting elements 106 over two shared conductors. Sharing conductors can reduce the cost of decorative lighting module 100.

Data/power controller 102 includes input connector 108 and output connector 110. Input and output connectors 108 and 110 can be configured to interface, via one of the protocols for providing both power and data to individually-controllable lighting elements, with upstream and downstream modules, respectively, of a decorative lighting system. The protocols of any upstream and downstream modules connected via connectors 108 and 110 do not need to be the same protocol as is used for individually-controllable lighting elements 106 of tap lighting display 104. Data/power controller 102 is configured to translate the data signal(s) from the data/power protocol corresponding to input connector 108, and to convert the power received via input connector 108 to the date/power protocol used by individually-controllable lighting elements 106 of tap lighting display 104. In some embodiments, input and output connectors 106 and 108 can be three- or four-conductor connectors having a power line, a data line, and at least one reference line, for example. Such three- or four-conductor connectors can interface with systems described above having separate data and power lines. In other embodiments, input and output connectors 106 and 108 can be two-conductor connectors which are shared by the data signals and power.

Data/power controller 102 receives, via input connector 108, data signals for all individually controllable lighting elements of the entire decorative lighting system, which are downstream of input connector 108 (i.e., all individually controllable lighting elements 106 of tap lighting display 104 as well as those of any decorative lighting elements connected, via output connector 110, to light string 100). Data/power controller 102 identifies the data signals corresponding to tap lighting display 104 and translates the identified data signals to the data-over-power protocol used by individually-controllable lighting elements 106 of tap lighting display 104. Such a translation can include superimposing (e.g., by superposition) the data signals onto the power conductor. Data/power controller 102 also relays, to output connector 110, any data signals that correspond to individually-controllable lighting elements of any decorative lighting elements connected via output connector 110. Data/power controller 102 can remove the identified data signals corresponding to tap lighting display 104 from those received via input connector 108 and then send the data signals received via input connector 108 minus those identified data signals corresponding to tap lighting display 104 to output connector 110.

FIG. 10B depicts a decorative lighting module that has input and output connectors on opposite ends of the decorative lighting module. In FIG. 10B, decorative lighting module 120 includes data/power controller 122 and lighting display 124. Lighting display 124 includes a plurality of individually-controllable lighting elements 126, which can be wired in various fashions. In some embodiments, individually-controllable lighting elements 126 can be wired in series. In other embodiments, individually-controllable lighting elements 126 can be wired in parallel. In still other embodiments, individually-controllable lighting elements 126 can be wired in a series-parallel fashion. In any of these configurations, however, both power and data signals can be provided to the individually-controllable lighting elements 126 over two shared conductors. Sharing conductors can reduce the cost of decorative lighting module 120.

As in the FIG. 10A embodiment, data/power controller 122 includes input connector 128 and output connector 130, although in the FIG. 10B embodiment, input and output connectors are on opposite ends of decorative lighting module 120. Input and output connectors 128 and 130 can be configured to interface, via one of the protocols for providing both power and data to individually-controllable lighting elements, with upstream and downstream modules, respectively, of a decorative lighting system. The protocols of any upstream and downstream modules connected via connectors 128 and 130 do not need to be the same protocol as is used for individually-controllable lighting elements 126 of tap lighting display 124. Data/power controller 122 is configured to translate the data signal(s) from the data/power protocol corresponding to input connector 128, and to convert the power received via input connector 128 to the date/power protocol used by individually-controllable lighting elements 126 of tap lighting display 124. In some embodiments, input and output connectors 126 and 128 can be three- or four-conductor connectors having a power line, a data line, and at least one reference line, for example. Such three- or four-conductor connectors can interface with systems described above having separate data and power lines. In other embodiments, input and output connectors 106 and 108 can be two-conductor connectors which are shared by the data signals and power.

Data/power controller 122 receives, via input connector 128, data signals for all individually controllable lighting elements of the entire decorative lighting system, which are downstream of input connector 128 (i.e., all individually controllable lighting elements 126 of tap lighting display 124 as well as those of any decorative lighting elements connected, via output connector 130, to light string 120). Data/power controller 122 identifies the data signals corresponding to tap lighting display 124 and translates the identified data signals to the data-over-power protocol used by individually-controllable lighting elements 126 of tap lighting display 124. Such a translation can include superimposing (e.g., by superposition) the data signals onto the power conductor.

Data/power controller 122 also relays, to output connector 130, any data signals that correspond to individually-controllable lighting elements of any decorative lighting elements connected via output connector 130. Data/power controller 122 can remove the identified data signals corresponding to tap lighting display 124 from those received via input connector 108 and then send the data signals received via input connector 128 minus those identified data signals corresponding to tap lighting display 124 to output connector 130. Because output connector 130 and input connector 128 are on opposite ends of decorative lighting module 120, an additional conductor traverses lighting display 124 than traverses lighting display 104 depicted in FIG. 10A. This additional conductor communicates either the data/power corresponding to lighting display 124 or data/power sent to output connector 130, depending on where data/power controller 122 is located.

Figure 11:
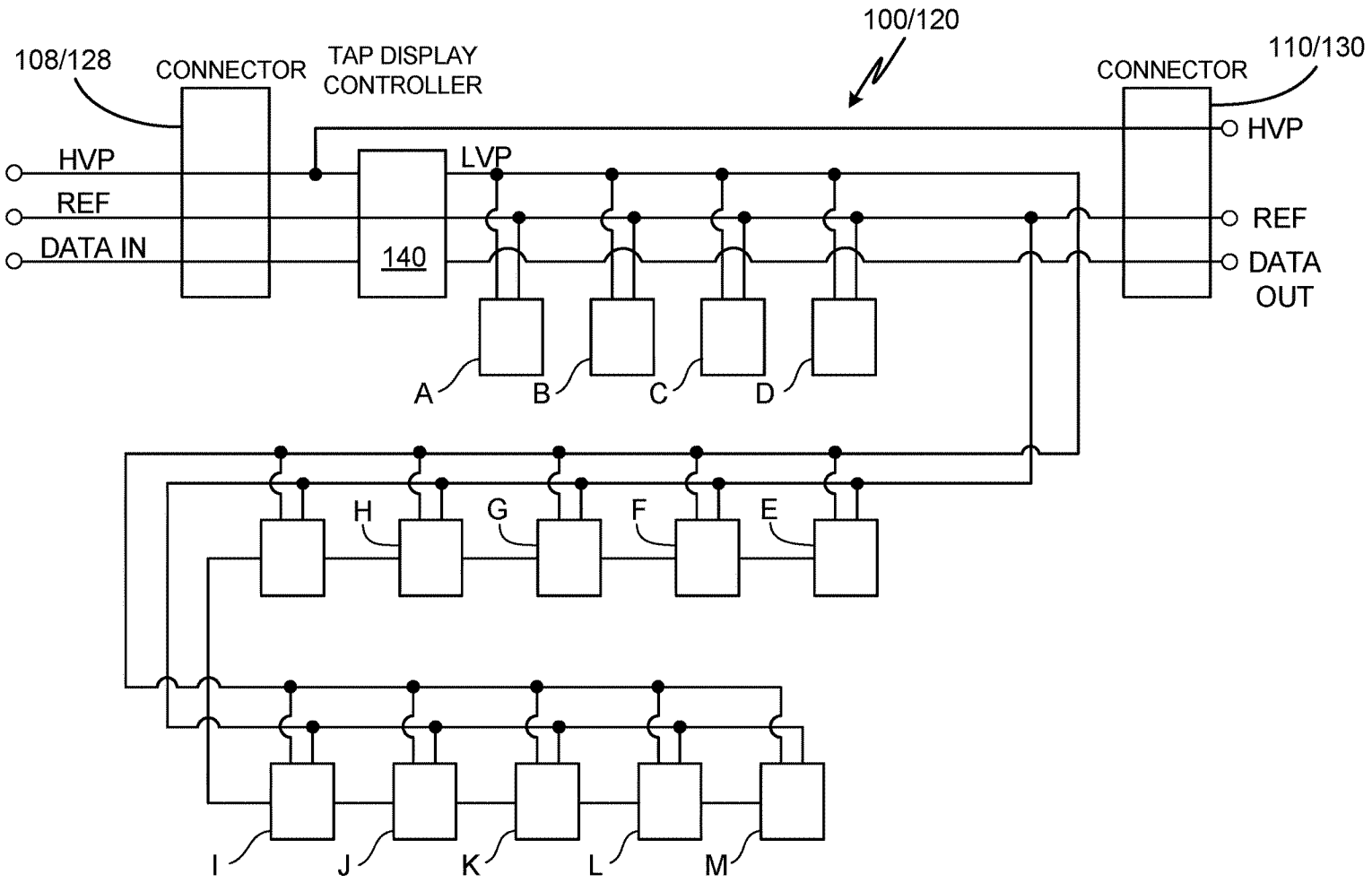
FIG. 11 is a block diagram of an embodiment of a decorative lighting module having a data/power controller.

FIG. 11 is a block diagram of an embodiment of a decorative lighting module having a data/power controller. In FIG. 11, decorative lighting module 100/130 includes data/power controller 102/122 and lighting display 104/124. Decorative lighting module 100/130 can represent either decorative lighting module 100 depicted in FIG. 10A or decorative lighting module 120 depicted in FIG. 10B, depending on the relative locations of input and output connectors 108/128 and 110/130. If, for example, input and output connectors 108/128 and 110/130 are located on the same end of decorative lighting module 100/130, with respect to lighting display 104/124, then the FIG. 11 embodiment represents decorative lighting module 100 depicted in FIG. 10A. If, however, input and output connectors 108/128 and 110/130 are located on opposite ends of decorative lighting module 100/130, then the FIG. 11 embodiment represents decorative lighting module 120 depicted in FIG. 10B.

Input connector 108/128 is configured to releaseably connect to an upstream module of the decorative lighting system. Input connector 108/128 is further configured to receive, from the upstream module connected thereto, operating power. Input connector 108/128 is also configured to receive, from the upstream module connected thereto, an input signal including a plurality of command signals, each configured to cause a specific one of individually-controllable lighting elements A-M of decorative lighting module 100/120 to illuminate in a specific manner indicated by the lighting command.

Data/power controller 102/122 includes tap display controller 140, which translates the data/power from the protocol corresponding to how data and power are received by input connector 108/128 to the two-wire protocol corresponding to tap lighting display 104/124. In the embodiment depicted in FIG. 11, individually-controllable lighting elements A-M are wired in parallel, receiving both operating power and data from conductors 140 and 142. In other embodiments, individually-controllable lighting elements A-M can be wired in series or in a series-parallel fashion. Tap display controller 140 is configured to provide operating power to conductors 140 and 142, which are conductively coupled to a tap lighting display 104/124 connected thereto. Tap display controller 140 is further configured to provide a tap signal to conductors 140 and 142, so as to superimpose the tap signal onto the provided operating power. The tap signal includes a first subset of the plurality of command signals corresponding to one or more individually-controllable lighting element(s) of the tap lighting display connected thereto.

In some embodiments, data/power controller 102/122 can have a tap connector conductively coupled to the pair of conductors and configured to releaseably connect to tap lighting display 104/124.

In some embodiments, the tap signal indicative of a first subset of the plurality of lighting commands can be a time sequence of signals, each having an address and a command corresponding to one of individually-controllable lighting elements A-M of the tap lighting display 104/124.

In some embodiments, the input signal indicative of a first subset of the plurality of lighting commands can be a time sequence of signals, each having an address and a command corresponding to one of a plurality of individually-controllable lighting elements of the decorative lighting system.

In some embodiments, the input signal including a plurality of command signals can be a time sequence of the command signals, each having an index corresponding to its relative time location within the time sequence, wherein each index corresponds to a specific one of the plurality of lighting elements of the decorative light system.

In some embodiments, tap display controller 140 can be further configured to generate the output signal by removing a first predetermined number of the time sequence of commands from the input signal.

In some embodiments, tap display controller 140 can be further configured to select a first predetermined number of the time sequence of commands from the input signal. Tap display controller 140 can also be configured to assign, to the selected time sequence of signals, addresses corresponding to the indices of the selected time sequence of commands In some embodiments, the first and second subsets of lighting commands can be mutually exclusive of one another.

In some embodiments, the operating power received via the input conductor can be a high-voltage operating power having a voltage greater than 48 volts.

In some embodiments, the operating power provided to the one or more controllable lighting elements can be a low-voltage operating power having a voltage less than 48 volts.

Output connector 110/130 is configured to releaseably connect to a downstream module of the decorative lighting system. Output connector 110/130 is further configured to provide, to the downstream module connected thereto, the operating power received by the input connector. Output connector 110/130 is also configured to provide, to the downstream module, an output signal including a second subset of the plurality of command signals corresponding one or more individually-controllable lighting element(s) of an output lighting display connected via the output connector.

Figure 12:
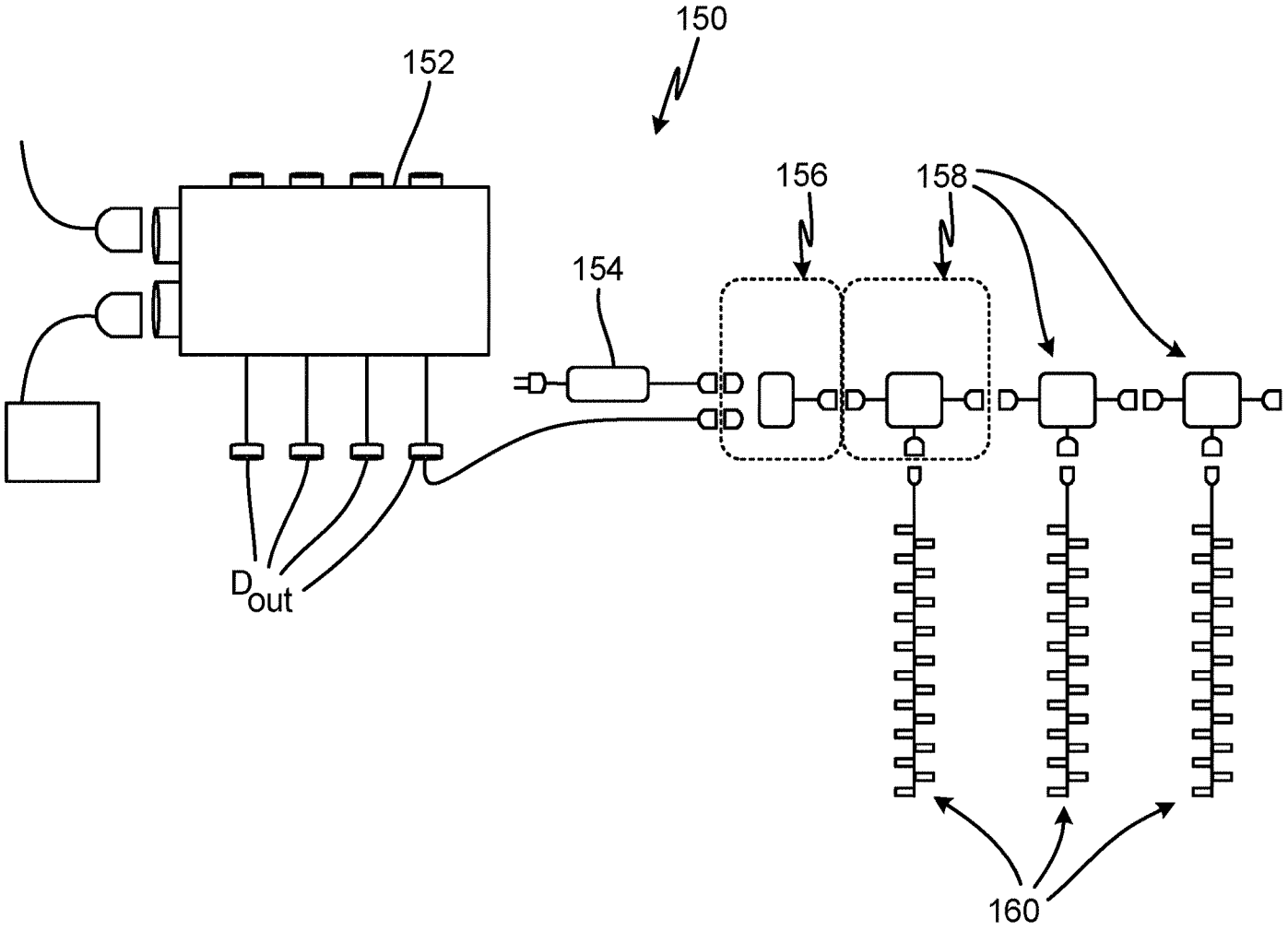
FIG. 12 depicts an embodiment of a decorative lighting system that has an assortment of lighting modules.

FIG. 12 depicts an embodiment of a decorative lighting system that has an assortment of lighting modules. In FIG. 12, decorative lighting system 150 includes master control unit 152, power source 154, data/power source 156, data/power tap controllers 158, and end-in-bulb light strings 160. Master control unit 152 receives, from a wired or wireless source, and/or retrieves from memory a plurality of command signals, each configured to cause a specific one of the individually-controllable lighting elements of the decorative lighting system. Master control unit 152 then generates a control signal indicative of the received or retrieved plurality of command signals, and provides the generated control signal to one or more output ports $D_{OUT}$.

Power source 154 can be a 120 Volt AC source, a high-voltage DC source (e.g., >48 VDC), a low-voltage DC source (e.g., 24 VDC), a solar cell, etc. Data/power source 156 receives power from power source 154 and the control signal provided by master control unit 152.

Data/power source 156 then generates data signals and power according to a decoratively lighting data/power protocol. In some embodiments, data signals and power can be generated according to one or more of the protocols disclosed above. Data/power tap controller 158 receives data signals and power at an input connector, translates the receive data signal and power according to a protocol of the end-in-bulb light string 160 attached thereto. In some embodiments, data/power tap controller 158 can provides a data signal to the tap connector that only has command signals corresponding to individually-controllable lighting elements of the decorative lighting system that are connected via the tap connector.

Data/power tap controller 158 then provides the translated data signal and power to the tap connector. Data/power tap controller 158 also provides a data signal and power to an output connector. In some embodiments, data/power tap controller 158 can provides a data signal to the output connector that only has command signals corresponding to individually-controllable lighting elements of the decorative lighting system that are connected via the output connector.

Figure 13:
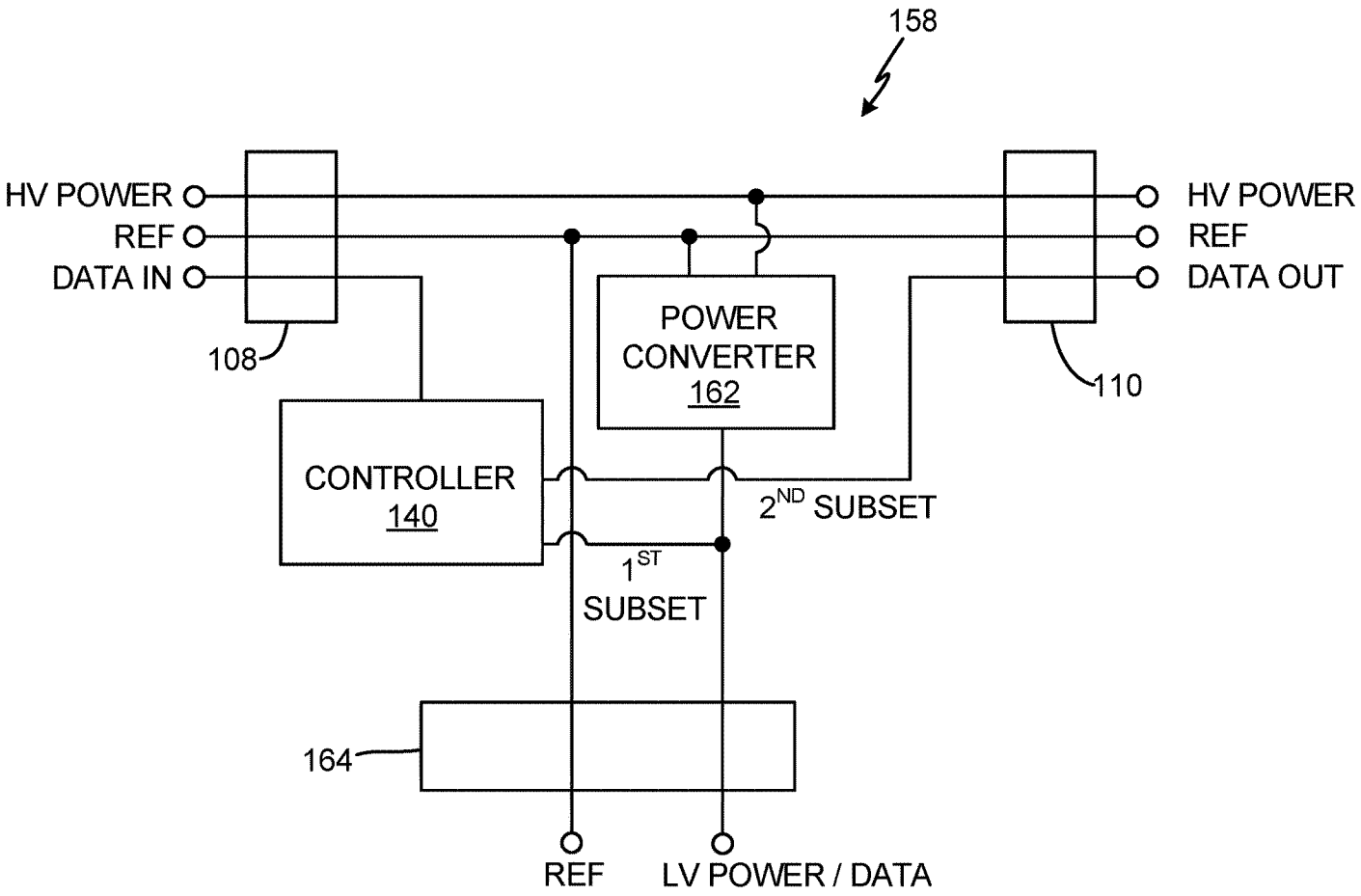
FIG. 13 is an embodiment of a data/power tap controller.

FIG. 13 is an embodiment of a data/power tap controller. In FIG. 13, data/power tap controller 158 includes input connector 108, output connector 110, tap display controller 140, power controller 162, and tap connector 164. In the depicted embodiment, input and output connectors 108 and 110 have three conductors, while tap connector 164 has two conductors, which indicates that the data/power protocol received by and supplied to input and output connectors 108 and 110, respectively, is different that the data/power protocol supplied to tap connector 164. Input and output connectors 108 1nd 110 have separate data and power lines sharing a common reference line. Tap connector 164 has a reference line and a shared data/power line.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A data/power controller for a decorative lighting module having a plurality of independently-controllable lighting elements, the data/power controller comprising:

an input connector configured to releaseably connect to an upstream module of the decorative lighting system and further configured to:

receive, from the upstream module connected thereto, operating power; and receive, from the upstream module connected thereto, an input signal including a plurality of command signals, each configured to cause a specific one of the individually-controllable lighting elements of the decorative lighting system to illuminate in a specific manner indicated by the lighting command;

a tap display controller conductively coupled to the input connector and configured to receive, from the input connector, both the operating power and the input signal, the tap display controller further configured to:

provide operating power to a pair of conductors configured to conductively couple to a tap lighting display connected thereto; and provide a tap signal to the pair of conductors so as to superimpose the tap signal onto the provided operating power, the tap signal includes a first subset of the plurality of command signals corresponding to one or more individually-controllable lighting element(s) of the tap lighting display connected thereto; and an output connector configured to releaseably connect to a downstream module of the decorative lighting system and further configured to:

provide, to the downstream module connected thereto, the operating power received by the input connector; and provide, to the downstream module, an output signal including a second subset of the plurality of command signals corresponding one or more individually-controllable lighting element(s) of an output lighting display connected via the output connector.

2. The data/power controller of claim 1, further comprising:

a tap connector conductively coupled to the pair of conductors and configured to releaseably connect to the tap lighting display.

3. The data/power controller of claim 1, wherein the tap signal indicative of a first subset of the plurality of lighting commands comprises a time sequence of signals, each having an address and a command corresponding to one of one or more individually-controllable lighting element(s) of the tap lighting display.

4. The data/power controller of claim 1, wherein the input signal indicative of a first subset of the plurality of lighting commands comprises a time sequence of signals, each having an address and a command corresponding to one of a plurality of individually-controllable lighting elements of the decorative lighting system.

5. The data/power controller of claim 1, wherein the input signal including a plurality of command signals comprises a time sequence of the command signals, each having an index corresponding to a specific one of the plurality of lighting elements of the decorative light system.

6. The data/power controller of claim 5, wherein the tap display controller is further configured to:

generate the output signal by removing a first predetermined number of the time sequence of commands from the input signal.

7. The data/power controller of claim 5, wherein the tap display controller is further configured to:

select a first predetermined number of the time sequence of commands from the input signal; and assigning, to the selected time sequence of signals, addresses corresponding to the indices of the selected time sequence of commands.

8. The data/power controller of claim 1, further comprising:

the tap lighting display, wherein the tap lighting display is fixedly connected to the pair of conductors.

9. The data/power controller of claim 8, wherein the tap lighting display is a light string having a plurality of individually-controllable lighting elements distributed between a first end and a second end, wherein the input and output connectors are located at the first end of the light-string.

10. The data/power controller of claim 8, wherein the tap lighting display is a light string having a plurality of individually-controllable lighting elements distributed between a first end and a second end, wherein the input and output connectors are located at the opposite ends of the light-string.

11. The data/power controller of claim 1, wherein the first and second subsets of lighting commands are mutually exclusive of one another.

12. The data/power controller of claim 1, wherein the operating power received via the input conductor is a high-voltage operating power having a voltage greater than 48 volts.

13. The data/power controller of claim 12, wherein the operating power provided to the one or more controllable lighting elements is a low-voltage operating power having a voltage less than 48 volts.

14. The data/power controller of claim 13, wherein the tap display controller includes:

a power converter configured to convert the high-voltage operating power received via the input connector to the low-voltage operating power provided to the pair of conductors.

15. The data/power controller of claim 1, wherein each of the one or more controllable lighting elements of the decorative lighting system is configured to illuminate in response to and in a manner indicated by a corresponding one of the plurality of lighting commands.

16. The data/power controller of claim 1, wherein the pair of conductors is a first pair of conductors, the tap lighting display is a first tap lighting display, and the tap signal is a first tap signal, wherein the tap element controller is further configured to:

provide operating power to a second pair of conductors configured to conductively couple to a second tap lighting display connected thereto; and provide a second tap signal to the second pair of conductors so as to superimpose the second tap signal onto the provided operating power, the second tap signal includes a third subset of the plurality of command signals corresponding to one or more individually-controllable lighting element(s) of the second tap lighting display connected thereto.

17. The data/power controller of claim 1, wherein the one or more individually-controllable lighting element(s) of the tap lighting system is a plurality of individually-controllable lighting elements connected in series.

18. The data/power controller of claim 1, wherein the one or more individually-controllable lighting element(s) of the tap lighting system is a plurality of individually-controllable lighting elements connected in parallel.

19. The data/power controller of claim 1, wherein the one or more individually-controllable lighting element(s) of the tap lighting system is a plurality of individually-controllable lighting elements connected in series/parallel fashion.

* * * * *